US010654601B2

(12) United States Patent
Giublin et al.

(10) Patent No.: US 10,654,601 B2
(45) Date of Patent: May 19, 2020

(54) METHOD OF MANAGING A SET OF LIDS, STACKED AND INSERTED IN A PACKAGE, TRANSPORT DEVICE FOR TRANSPORTING A SET OF STACKED LIDS AND INSERTED IN A PACKAGE, AND SYSTEM FOR PRODUCING PALLETIZED SET OF LIDS

(71) Applicant: REXAM BEVERAGE CAN SOUTH AMERICA S.A., Rio de Janeiro (BR)

(72) Inventors: Bruno Leonardo Giublin, São José dos Campos (BR); Guilherme Kisseloff Coracini, São José dos Campos (BR); Tales Gustavo Vieira, Belo Horizonte (BR)

(73) Assignee: BALL BEVERAGE CAN SOUTH AMERICA S.A., Rio de Janeiro (BR)

( * ) Notice: Subject to any disclaimer, the term of this patent is extended or adjusted under 35 U.S.C. 154(b) by 235 days.

(21) Appl. No.: 15/532,341

(22) PCT Filed: Dec. 3, 2015

(86) PCT No.: PCT/IB2015/059331

§ 371 (c)(1),
(2) Date: Jun. 1, 2017

(87) PCT Pub. No.: WO2016/088079

PCT Pub. Date: Jun. 9, 2016

(65) Prior Publication Data

US 2017/0327256 A1 Nov. 16, 2017

(30) Foreign Application Priority Data

Dec. 4, 2014 (BR) ..... 1020140303049

(51) Int. Cl.
*B65B 35/50* (2006.01)
*B65B 5/06* (2006.01)
(Continued)

(52) U.S. Cl.
CPC ..... *B65B 35/50* (2013.01); *B65B 5/067* (2013.01); *B65B 7/08* (2013.01); *B65B 5/106* (2013.01); *B65B 35/42* (2013.01); *B65B 43/22* (2013.01)

(58) Field of Classification Search
CPC .. B65B 7/00; B65B 5/06; B65B 39/06; B65B 7/08
(Continued)

(56) References Cited

U.S. PATENT DOCUMENTS 5,016,420 A * 5/1991 Chiappe ..... B65B 9/13 53/138.1
5,175,980 A * 1/1993 Chiappe ..... B65B 9/13 53/168
(Continued)

FOREIGN PATENT DOCUMENTS

CH 687977 A5 4/1997
CN 1115176 A 1/1996
(Continued)

OTHER PUBLICATIONS

Written Opinion and Search Report for PCT/IB2015/059331 dated Oct. 3, 2016 (11 pages).
(Continued)

*Primary Examiner* — Hemant Desai
*Assistant Examiner* — Jacob A Smith
(74) *Attorney, Agent, or Firm* — Greer, Burns & Crain, Ltd.

(57) ABSTRACT

The present invention relates to a method and a device of managing a set (42) of lids, stacked and inserted in a packaging, including the steps of pressing said set (42) and displacing it, with a transport device (1), keeping the lids in the packaging; pressing a second portion (44) of the set (42) with a handle (23); moving the handle (23) so as to take at
(Continued)

least a part of the second portion (44) towards the first portion (43); displacing the handle (23) so as to place the second portion (44) against the first portion (43); immobilizing the second portion (44) against the first portion (43) with an immobilizing device (9); opening the handle (23) and moving it away from the set (42). The invention also relates to a system for producing palletized sets of lids.

13 Claims, 10 Drawing Sheets

(51) Int. Cl.

| | |
|---|---|
| ***B65B 7/08*** | (2006.01) |
| *B65B 5/10* | (2006.01) |
| *B65B 35/42* | (2006.01) |
| *B65B 43/22* | (2006.01) |

(58) Field of Classification Search
USPC ..... 53/447, 469, 476, 480, 481, 482, 542, 53/284.7, 370, 374.4, 375.2, 375.36, 53/375.7; 493/257, 258, 259, 260
See application file for complete search history.

(56) References Cited

U.S. PATENT DOCUMENTS

| | | | | |
|---|---|---|---|---|
| 5,685,129 | A * | 11/1997 | Baker | B65B 7/10 53/254 |
| 6,558,108 | B1 * | 5/2003 | Van Oord | B65B 61/207 206/386 |
| 7,275,353 | B2 * | 10/2007 | Williams | G07F 11/44 53/300 |
| 2002/0125727 | A1 * | 9/2002 | Kazerooni | B25J 15/00 294/86.4 |
| 2004/0045264 | A1 * | 3/2004 | Akaho | B65B 7/04 53/467 |
| 2004/0112784 | A1 * | 6/2004 | Colas | B31B 70/00 206/524.1 |
| 2005/0161875 | A1 * | 7/2005 | Yuyama | B65B 5/105 271/2 |
| 2006/0053746 | A1 * | 3/2006 | Woodham | B65D 33/20 53/412 |

FOREIGN PATENT DOCUMENTS

| | | | | |
|---|---|---|---|---|
| CN | 1391523 | A | 1/2003 | |
| CN | 1615240 | A | 5/2005 | |
| EP | 0618134 | A1 * | 10/1994 | B65B 7/08 |
| EP | 0618134 | A1 | 10/1994 | |
| EP | 1473229 | A1 * | 11/2004 | B65B 5/105 |
| EP | 1473229 | A1 | 11/2004 | |
| JP | 2007320610 | A | 12/2017 | |

OTHER PUBLICATIONS

Chinese Office Action for Corresponding Chinese Patent Application No. 201580062279.9, dated Aug. 1, 2018.

* cited by examiner

METHOD OF MANAGING A SET OF LIDS, STACKED AND INSERTED IN A PACKAGE, TRANSPORT DEVICE FOR TRANSPORTING A SET OF STACKED LIDS AND INSERTED IN A PACKAGE, AND SYSTEM FOR PRODUCING PALLETIZED SET OF LIDS

The present invention relates to a method of managing a set of lids, stacked and inserted in a package, and to a transport device for transporting the set of lids.

Such a set of lids is generally applied in manufacturing metal containers, more particularly cans, such as cans used in the food industry for canning food or drink.

These cans are usually made up of a can body and a can lid that are provided separately to the company that fills the package/can.

The supply of lids to the packing company consist, in general, in the delivery of pallets loaded with stacked sets of lids, each stack being inserted into a package that generally has the shape of an elongate bag.

In producing these lid pallets, there is the need to optimize the method that allows grouping the lids on stacks, inserting the stacks in the package, closing the package, and placing this package on a pallet. The optimization of the method refers to the grouping of a larger number of stacks in the package in a shorter time interval.

DESCRIPTION OF THE PRIOR ART

This problem exists in various packaging industries that are involved with managing and packaging of stacked objects.

Prior art document PT1559650 describes an automatic bagging machine of lids in self-adhesive bags. A set of lids is introduced into a bag, and the bag is closed by two folding operations performed by a folding arm, a lower cylinder and an end cylinder.

Document U.S. Pat. No. 4,537,010 discloses, in turn, a palletizing system that places lids in bags, and in the location where each bag is filled, an L-shaped plate member is placed against the bag by an actuator, aimed at closing the bag.

BRIEF DESCRIPTION OF THE INVENTION

The purpose of the present invention is to improve methods and devices known in the efficiency indicators, namely, stacking cycle time and device volume related to the quantity of stacked lids.

To this end, the invention relates to a method for managing a set of lids, stacked and inserted in a package, the set having a first portion including the lid stack, and a second portion including an opening and the free end of the package.

The method comprises the following steps:

- pressing said set and moving it to a transport device, while keeping the lids in the package;
- pressing said second portion with a transport device handle;
- displacing the handle so as to take at least a part of the second portion towards the first portion;
- displacing the handle so as to place the second portion against the first portion;
- immobilizing the second portion against the first portion using an immobilizing instrument;
- opening the handle and moving it away from the set.

Another object of the invention is a transport device for transporting the set of stacked lids inserted in a package, characterized in that it comprises:

- a support tool for said set, adapted to hold the lids and the package;
- a movable handling tool relative to the support tool;
- an immobilizing device adapted for immobilizing a fold of the package;
- the support tool and the handling tool being mounted on a movable platform allowing the displacement of said set.

The invention thus allows management of the lids in a more flexible and faster manner. The operations of displacement of the packed lids allow them to be held in a secure mariner, with the lids held in the package even before closing them. The package closing operation can be carried out at any time during the displacement operation of the packed lids, thereby increasing productivity, in the sense that multiple operations may be combined. That is, it is avoided that closure is a separate operation, separated from the operations of assembling, conditioning and palletizing the set of lids.

The method and the device according to the present invention may be used in any industrial sector requiring managing sets of lids or other stacking elements, these elements being of any material or shape.

Preferred characteristics which can complement the method according to the invention are indicated below.

Sliding of the second portion occurs in relation to the handle, in the step of moving the handle so as to take at least a part of the second portion towards the first portion.

The handle can conform to the second portion in a geometry similar to an "S" in the step of displacing the handle so as to take at least a part of the second portion toward the first portion.

The step of pressing said second portion may be performed shortly after the boundary between the first portion and the second portion.

In the step of displacing the handle so as to take at least a part of the second portion towards the first portion, the handle can be moved, at first, following the radial direction of the set, and then following the axial direction of the set.

The immobilizing device can be opened prior to the step of displacing the handle so as to place the second portion against the first portion, it being closed after this step.

The set can be displaced by the transporting device simultaneously with the step of displacing the handle so as to take at least a part of the second portion towards the first portion.

The method may include a further step of bonding the second portion and the first portion.

Furthermore, preferred characteristics which may supplement the device according to the invention are indicated below.

The handling tool may include two movable handling rolls against each other.

The handling rolls are free in axial rotation and are provided with rubber rings.

The immobilizing device includes jaws provided with nails.

The movable platform includes a coupling plate for a robotic arm.

The support tool is coupled to the movable platform by means of a cylinder allowing a translation of the support tool in relation to the handling tool.

The support tool includes a stop to the rear of said set.

Another object of the invention is a system for producing palletized sets of lids including a device for forming sets of lids adapted to produce sets of formed lids, stacked and inserted in a package, and a palletizing device of said sets. This production system includes a transport device as described above coupled to a robotic arm so that the transport device is adapted to grasp the sets in said set forming device, and to transport these sets to the palletizing device performing a package closure operation.

BRIEF DESCRIPTION OF THE DRAWINGS

The invention is explained below with the aid of the description of a preferred embodiment, given by way of example, with reference to the figures, in which.

DETAILED DESCRIPTION OF THE FIGURES

Figure 1:
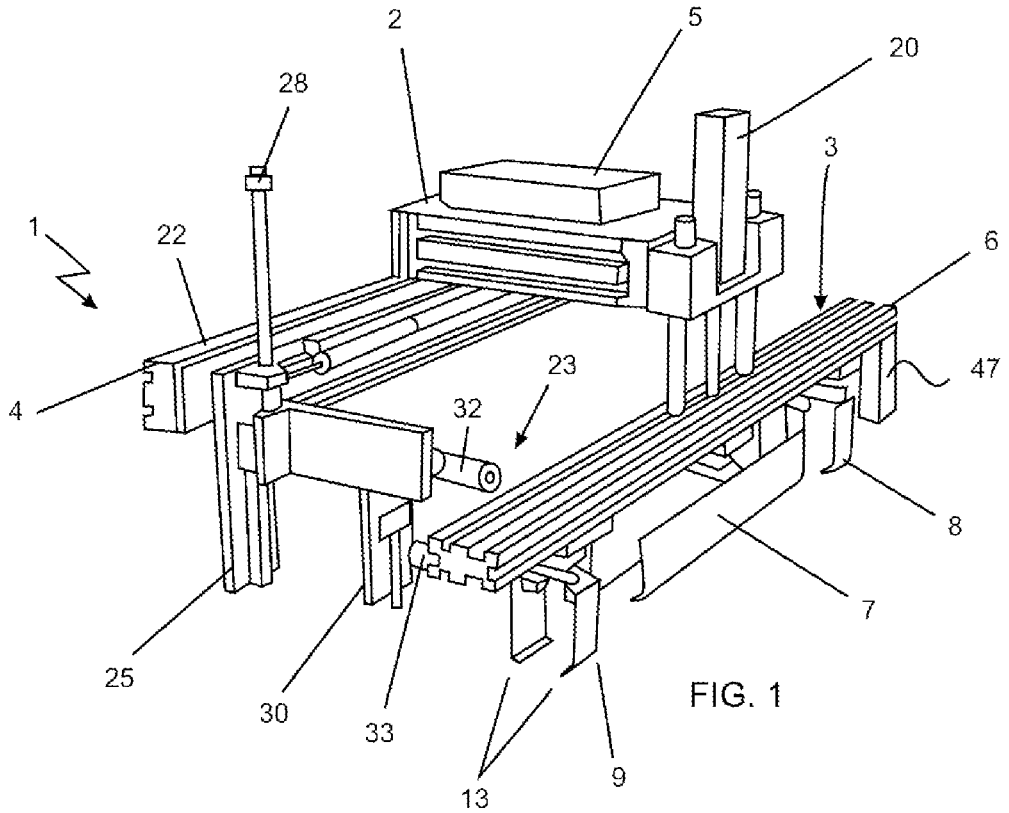
FIG. 1 is a perspective view of a device according to the invention in a first disposition.
Figure 2:
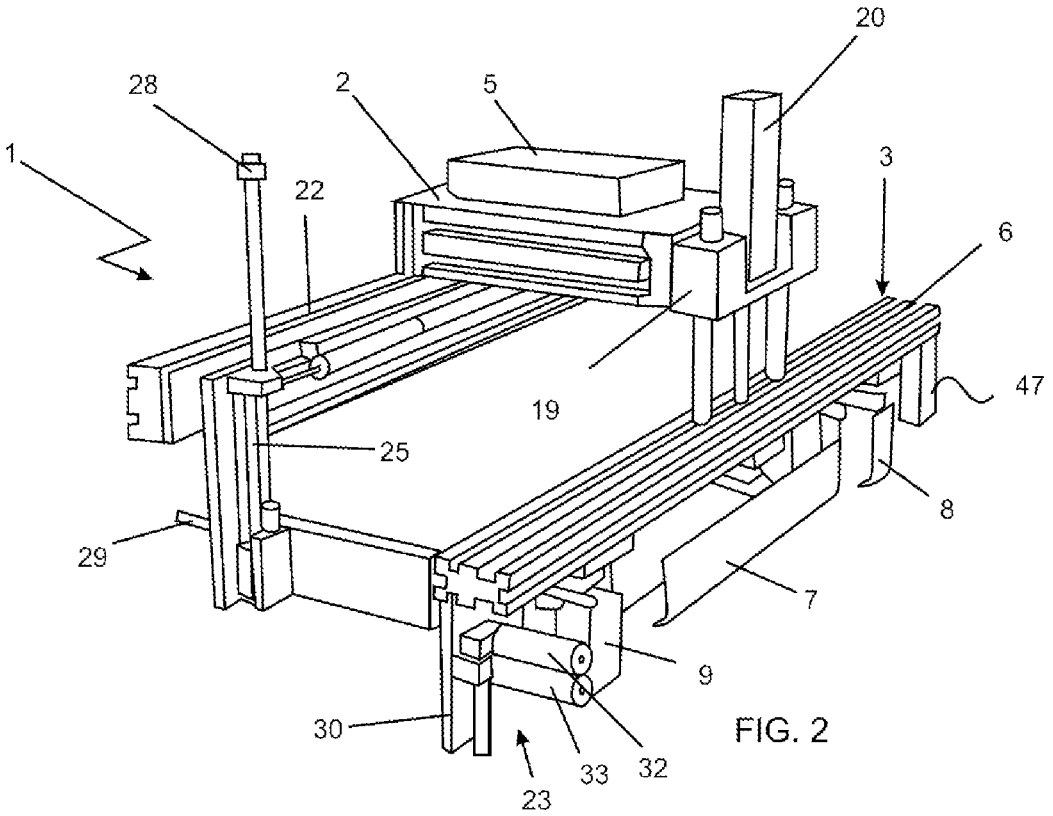
FIG. 2 illustrates the same device in a second disposition.

FIGS. 1 and 2 show a transport device 1 adapted to transport the stacked and packaged sets of lids.

Device 1 comprises a platform 2, on which are mounted a support tool 3 and a handling tool 4.

Platform 2 is equipped with a coupling plate 5 which allows the mechanical connection of device 1 to a robotic arm, or any displacement means capable of moving device 1 among different work sites that it is intended to occupy.

In fact, the application of device 1 of the present embodiment is to be inserted in a production line of can lids. This device 1 is intended to act between a device for forming sets of lids, and a palletizing device.

The devices for forming sets of lids and the palletizing devices are well known in the prior art and, therefore, will not be described herein.

It is only necessary to have the knowledge that such a device for forming sets of lids prepares and provides sets of stacked and packaged lids, and that such a palletizing device allows packaging of said packaged sets by batch, on pallets.

Device 1 will manage the sets of lids between these two devices.

To this end, support tool 3 includes a set of claws 7, 8, 9 coupled to a bar 6.

Figure 3:
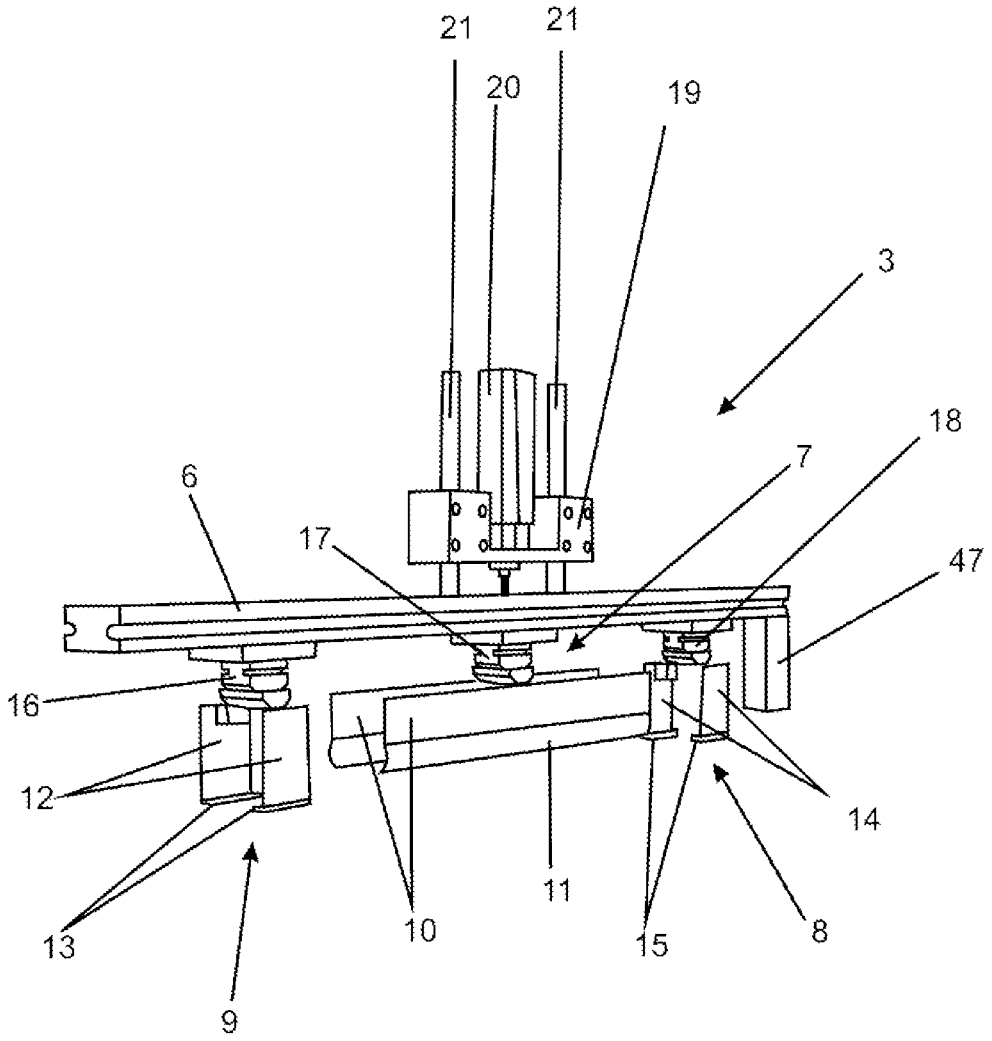
FIG. 3 is a partial view of the device of FIGS. 1 and 2.

The partial view of FIG. 3 shows this tool 3 highlighted, showing its details.

The claws include a central claw 7 and, on each side, a rear claw 8, and an immobilizing claw 9.

Central claw 7 comprises a pair of elongate jaws 10 occupying a substantial center space between rear claw 8 and immobilizing claw 9. These jaws 10 have one end 11 in a circular arc adapted to hold cylindrical objects longitudinally.

Jaws 12 of the immobilizing claw 9, in turn, have nails 13 extending in a horizontal plane beneath end 11 of jaws 10 of the center claw 7.

Nails 13 are adapted for immobilizing a fold against a cylindrical object held by the center claw 7, as will be explained below.

Rear claw 8, also included in the support tool 3 holds the rear of a cylindrical object held by center claw 7. Jaws 14 of this claw 8 also have nails 15 which may act for immobilizing any folds in the back part of a cylindrical object held by the center claw 7.

The three claws 7, 8, 9 are coupled to bar 6, each by means of an actuator 16, 17, 18. Each of these actuators 16, 17, 18 is able to move away or move close the jaws which it is attached to, from each other, causing the opening or closing of the corresponding claw.

Actuator 16 of the immobilizing claw 9 can be actuated independently of actuator 17 of center claw 7, in order to carry out the fold described below.

In turn, actuator 18 of the rear claw 8 can be actuated simultaneously with actuator 17 of center claw 7 to complete the action of the latter. Alternatively, they may also be actuated independently to allow claw 8 to perform an immobilizing function of a potential fold in the rear part, if necessary.

Support tool 3 also includes a stop 47 adapted to the rear of a packaging to be compressed against it.

Support tool 3 is secured on platform 2 by means of a base 19. A cylinder 20 and two guide rails 21 allow the translation of bar 6 and, therefore, of claws 7, 8, 9 in relation to platform 2.

Figure 4:
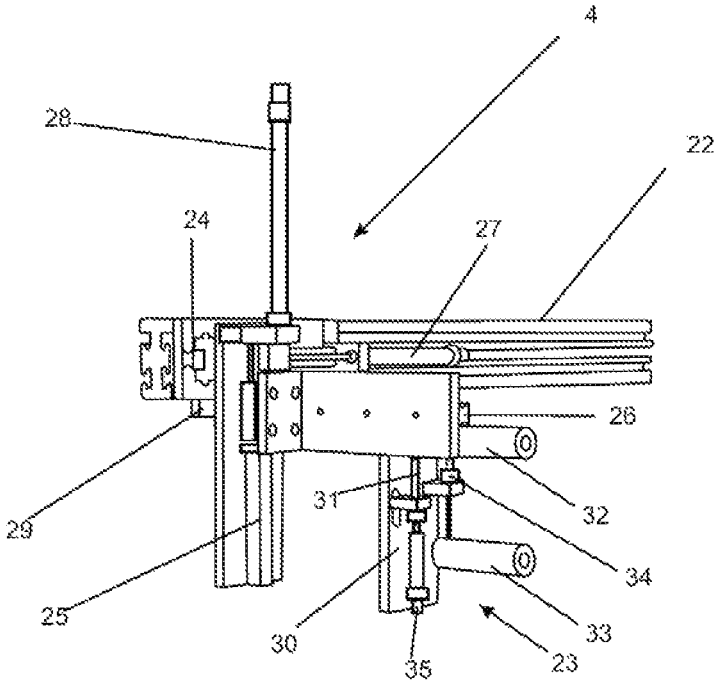
FIGS. 4 and 5 are also partial views of the device of FIGS. 1 and 2.
Figure 5:
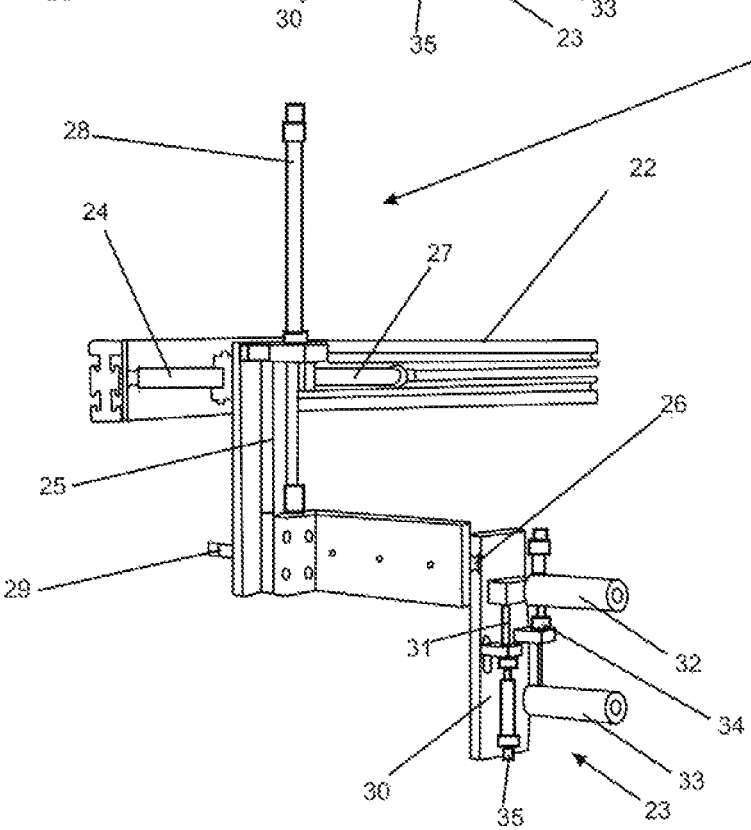

Considering handling tool 4, which is also included in the transport device 1, FIGS. 4 and 5 show this tool 4 in two extreme positions, that is, a retracted position (FIG. 4) and an extended position (FIG. 5).

This handling tool 4 includes a support bar 22 and a handle 23 which is movable along three translations relative to bar 22. This movability is achieved by means of three orthogonal guide rails 24, 25, 26.

Each of the guide rails 24, 25, 26 is connected to a cylinder 27, 28, 29 to control movement of handle 23.

Handle 23 includes, in turn, a support plate 30 on which is mounted a guide rail 31, which has two handling rolls 32, 33 coupled to it.

Two cylinders 34, 35 are provided to move the handling rolls 32, 33 against each other, or push them away from each other.

Handling rolls 32, 33 are intended for arrest/retention of packages and can be rigid or flexible. In the current example, tests are performed with nylon rotating cylinders and may be provided with rubber rings 36 (see FIGS. 6 to 11) to increase the coefficient of friction. Alternatively, the rolls may be fixed.

This handling tool 4 is fixed on platform 2 to form the complete transport device 1 of FIGS. 1 and 2. In view of the three translations allowed by guide rails 24, 25, 26, handle 23 may move among various positions relative to the support tool 3, including the positions of FIGS. 1 and 2.

This possible movement of handle 23 will allow the folding operations of a packaging a lid when the transport device 1 is implemented on a lid production line.

Figure 12:
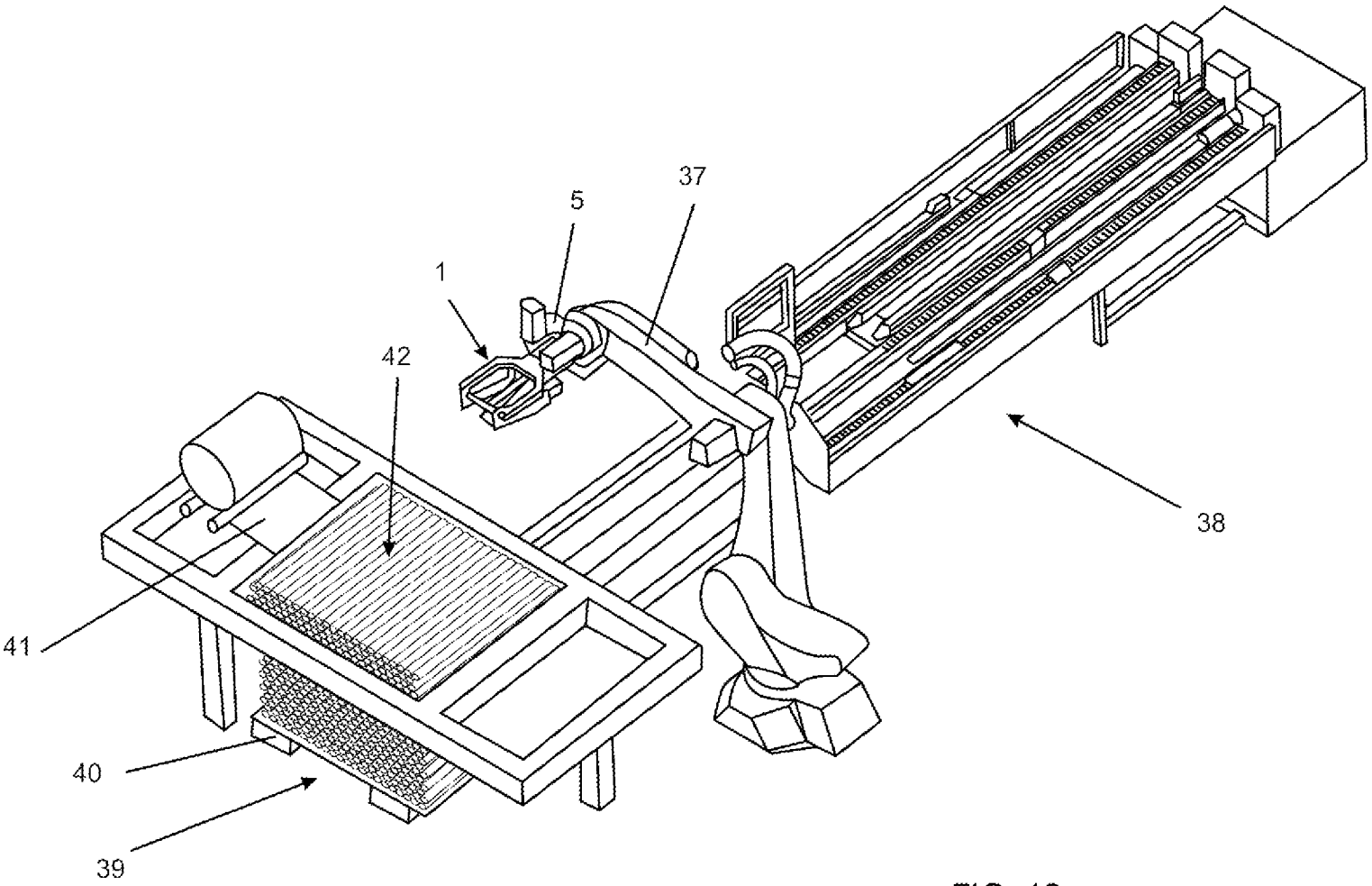
FIG. 12 is an overview of the implementation of the invention in a production line.

FIG. 12 shows such an implementation, according to this example, of the transport device 1 in such a lid production line.

In this FIG. 12, transport device 1 is coupled to a robotic arm at the level of the coupling plate 5. The transport device 1 is thus able to occupy any position within its workspace located between a packaging device 38 and a pallet support device 39.

Packaging device 38 is a classic device capable of forming stacks of lids and inserting them into a package that is open.

Pallet support device 39 is also a classic device capable of carrying a pallet 40, of keeping it at the appropriate level to receive stacks of packaged lids, and applying a film 41 for maintaining these packaged lids those packed on the pallet.

In this configuration, the role of the transport device 1 is to grasp each packed set of lids which leaves the packaging device 38, to transport this set to the palletizing device 39, and to position the set in the correct location on pallet 40. During this transport, transport device 1 further performs closing of the package as described below with reference to FIGS. 6 to 11.

Figure 6:
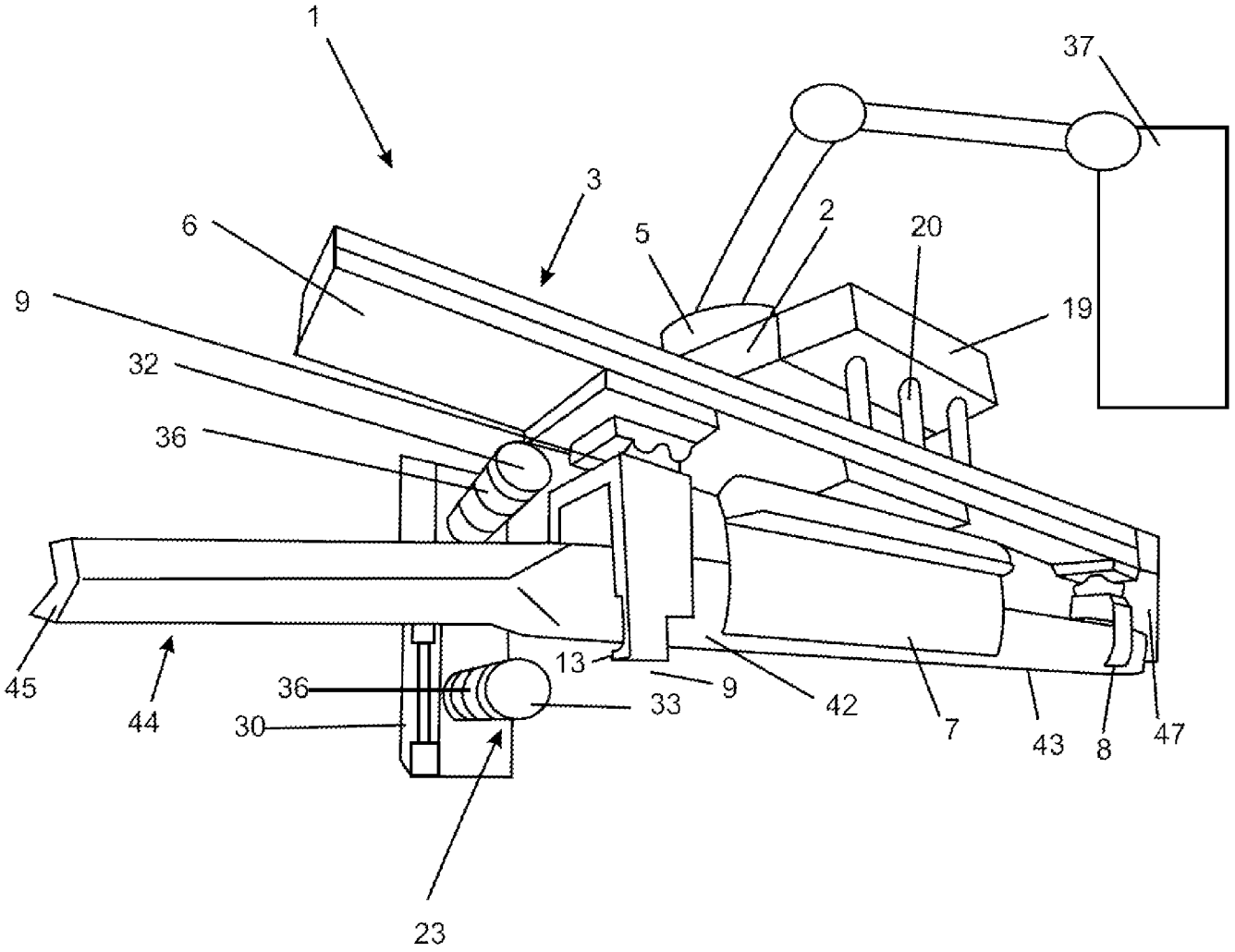
FIGS. 6 to 11 show the complete device in six working positions, illustrating the method according to the invention.

With reference to FIG. 6, transport device 1 is represented shortly after having grasped a packaged set of lids 42 leaving the packaging device 38.

For this operation, the three claws 7, 8, 9 are open and the robotic arm 37 positions the support tool 3 over a packed set of lids which, leaving the packaging device 38, is ready to be transported. With the movement of the robotic arm 37 and/or the cylinder 20, the jaws 7, 8, 9 are arranged on each side of the packaged set of lids 42, and then are closed, and the robotic arm 37 finally moves the transport device 1, taking the packaged set of lids 42, up to the position of FIG. 6.

FIG. 6 illustrates how claws 7, 8, 9 hold the lids on the package even before it is closed. Furthermore, transport device 1 maintains the compression of lids stacked on the package, holding set 42 between stop 47 and the immobilizing claw.

The packed set of lids 42 has a first portion 43 including the lid stack and the package portion that contains it, and a second portion 44 including the free end of the package, that is, the part of the package that extends freely beyond the lids up to opening 45.

It is emphasized that it was through this opening 45 that the set of lids was previously inserted up to the package bottom, by packaging device 38.

The folding operation can be carried out from this position of FIG. 6, and includes the positions of FIGS. 7 to 11. During this operation, the transport device 1 can be stopped in a safety position, or it may, alternatively, continue moving towards the palletizing device 39.

FIG. 6 shows that handle 23 moved to an extended and open position such that the handling rolls 32, 33 are positioned on each side of the packed set of lids 42, on the side of the second portion 44, but shortly after the boundary between the first portion 43 and the second portion 44, that is, shortly after the last lids of the stack which is inside the package.

Figure 7:
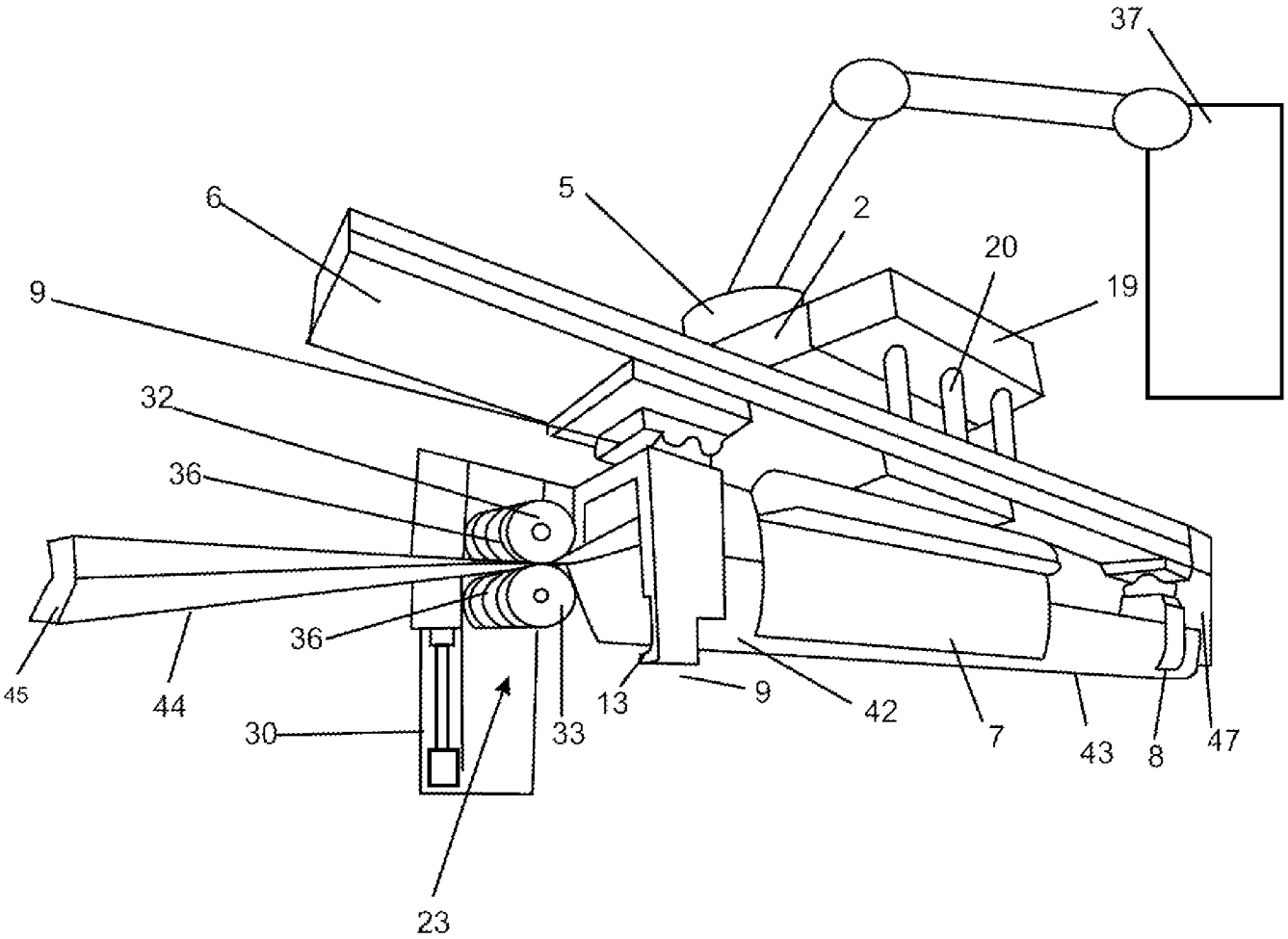

The operation continues as disclosed in FIG. 7 where handle 23 is closed onto the package, that is, handling rolls 32, 33 are placed against each other compressing the package immediately after the stack of lids.

Alternatively, the operation may also be carried out with the transport device 1 stopped up to this point in the method, and hereinafter, continue with the transport device 1 moving, since the lids are completely locked on the package.

Figure 8:
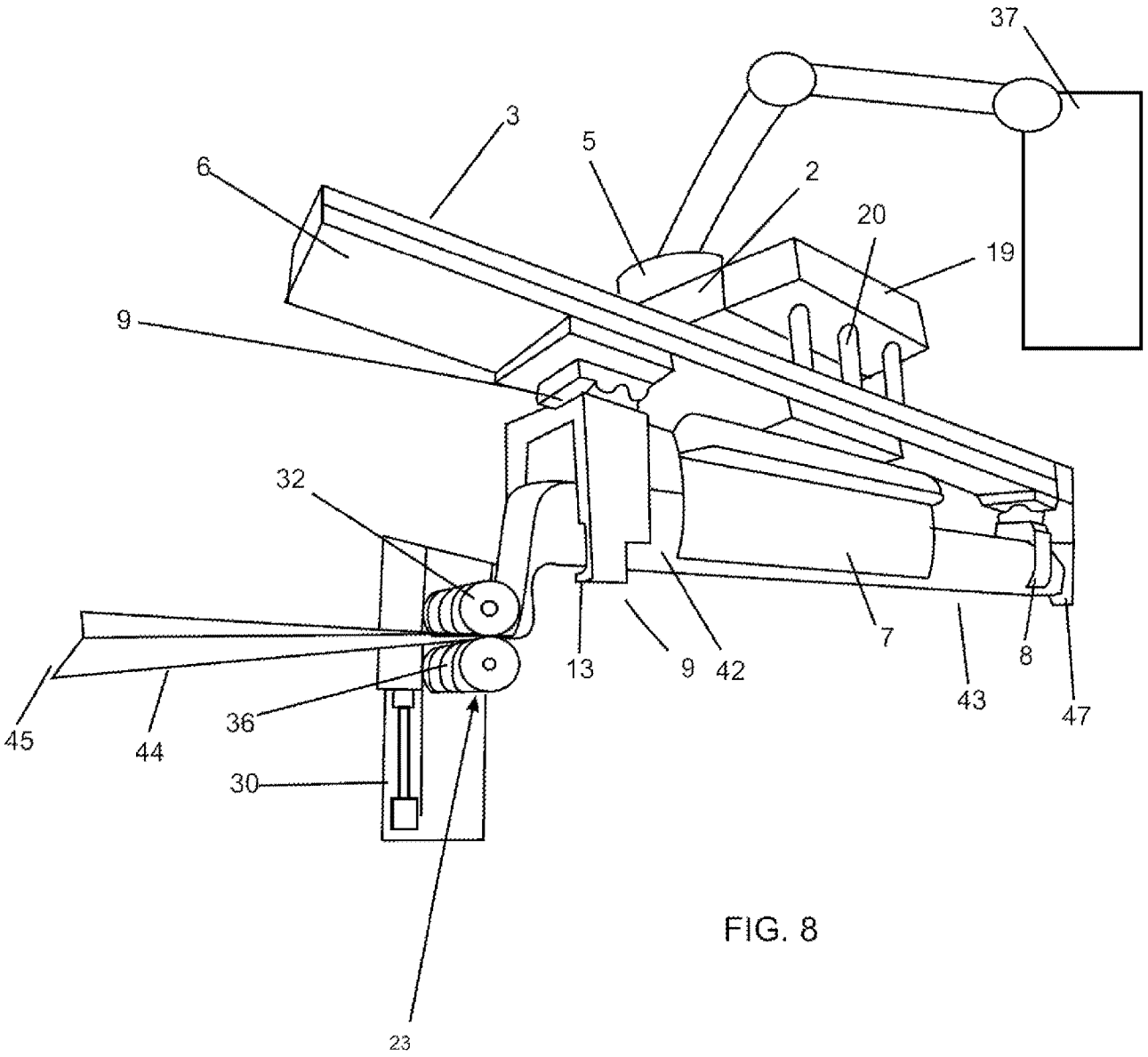

In any case, the next step is shown in FIG. 8. Handle 23 is kept closed and is moved in a direction transverse to the stack of lids, away from it. This relative movement between the handle 23 and the stack of lids is performed with the displacement of handle 23, allowed by guide rails 24, 25 of the handle and/or the displacement of the support tool 3 allowed by guide rail 21 and cylinder 20.

The rotation of the handling rolls 32, 33 allows a sliding between the package and handle 23 during this relative movement.

Figure 9:
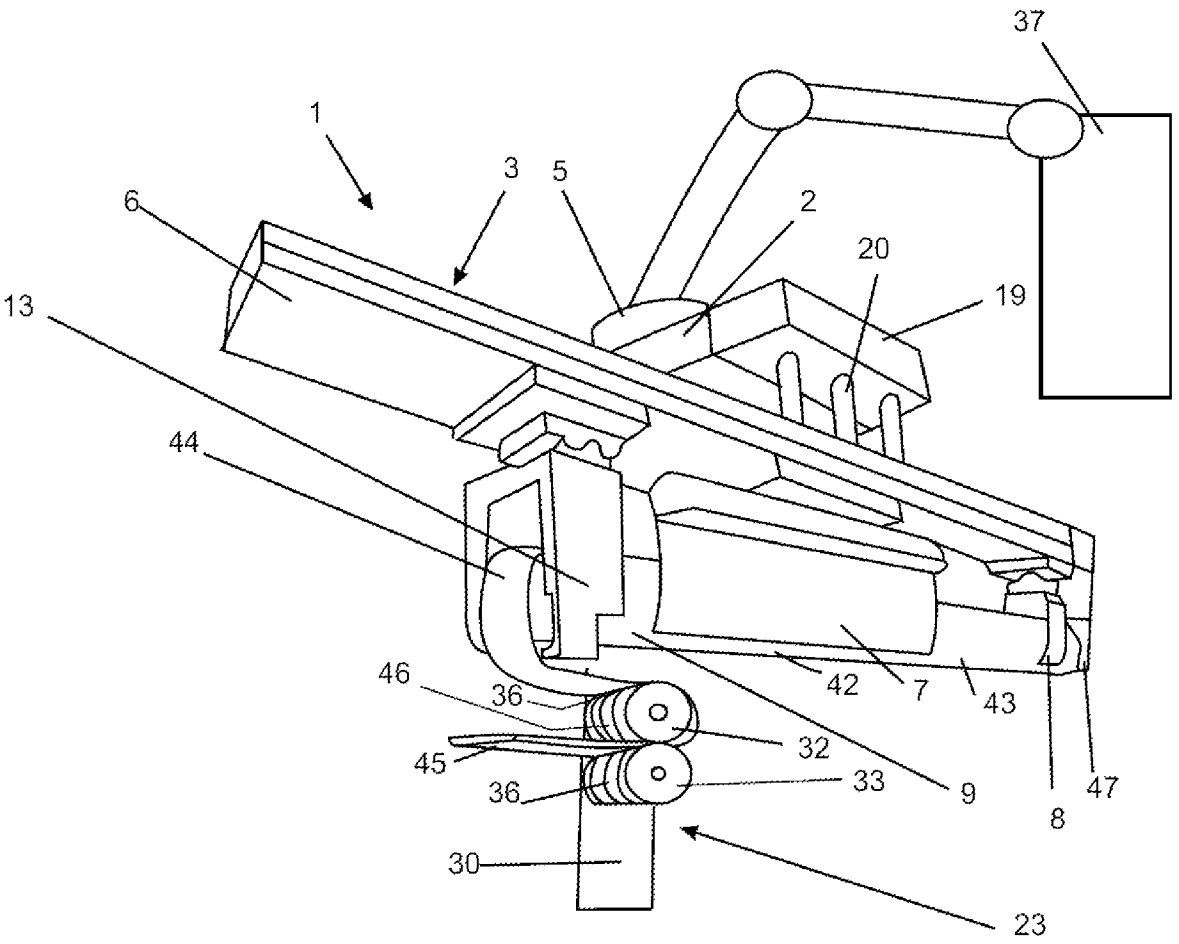

In FIG. 9, handle 23 continues its movement by displacing, now in parallel to the stack of lids, towards the first portion 43. The package thus forms a geometry similar to the "S" 46 and sliding continues. The stack of lids can thus be pressed on the package.

The immobilizing claw 9 is then opened as can be seen in FIG. 9, moving nails 13 away from the package.

The movement of FIGS. 8 and 9 can be done in several ways, since handle 23 is displaced about the first portion 43 so that the second portion 44 is brought towards the first portion 43.

Figure 10:
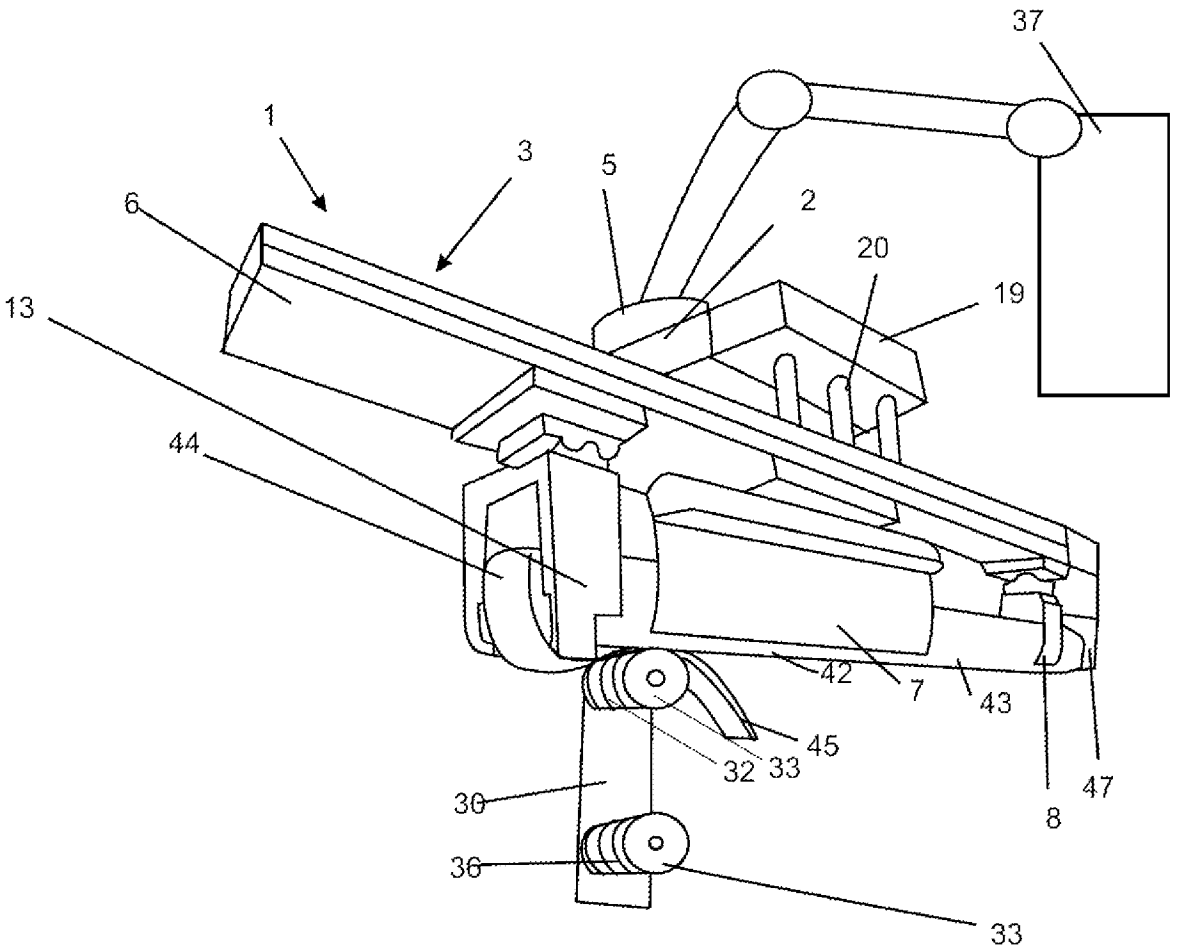

The next step illustrated in FIG. 10 is to move handle 23 so as to position the second portion 44 against the first portion 43. Specifically, handle 23 is moved until upper handling finger 32 will compress the second and first portions 44, 43. Handle 23 can now be opened, since the upper handling finger 32 hold the compression, as shown in FIG. 10.

Figure 11:
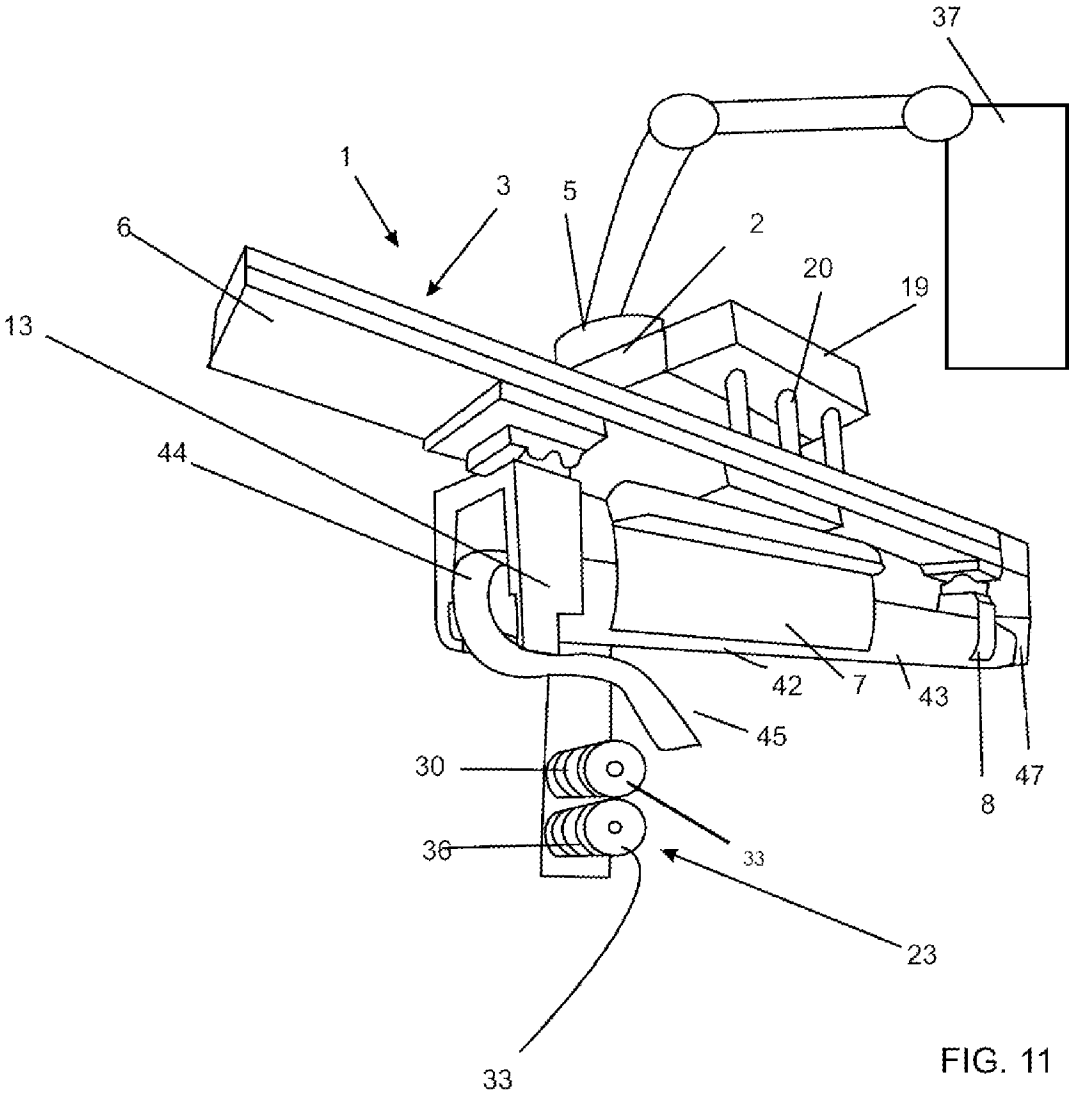

The open immobilizing claw 9 allows this compression and, thereafter, as illustrated in FIG. 11, the immobilizing claw 9 is closed so that nails 13 keep the second portion 44 in this position against the first portion 43.

Handle 23 can then be closed and retracted to the rest position of FIG. 11.

The packaging is thus folded and retained in the support tool 3.

Optionally, the support tool 3 can then transport the set of lids 42 thereby enclosed in the package to other plants to carry out additional operations such as labeling or sealing.

Transport device 1 finally places the packed set of lids 42 on pallet 40 (see FIG. 12).

Having described an example of a preferred embodiment, it should be understood that the scope of the present invention encompasses other possible variations, being limited solely by the wording of the appended claims, including the possible equivalents therein.

The invention claimed is:

1. A method of managing a set of lids (42) stacked and inserted into a package, the set (42) having a first portion (43) including a lid stack, and a second portion (44) including an opening (45) and a free end of the package, comprising the steps of:

pressing said set (42) and moving it to a transport device (1), while keeping the lids in the package;

pressing said second portion (44) with a handle (23) of the transport device (1);

displacing handle (23) so as to take at least a part of the second portion (44) towards the first portion (43);

displacing handle (23) so as to place the second portion against the first portion (43);

immobilizing the second portion (44) against the first portion (43) using an immobilizing device (9), wherein the immobilizing device (9) includes movable jaws (12) provided with nails (13), the nails (13) extending in a horizontal plane beneath the stack lids inserted in the package;

opening the handle (23) and moving it away from said set (42), wherein the immobilizing device (9) is opened before the step of displacing handle (23) so as to place the second portion (44) against the first portion (43), the immobilizing device (9) being closed after this step.

2. The method of claim 1 wherein sliding of the second portion (44) occurs relative to the handle (23), during the step of displacing the handle (23) so as to take at least a part of the second portion (44) towards the first portion (43).

3. The method of claim 1 wherein the handle conforms to the second portion (44) in in an S-shape (46) in the step of displacing handle (23) so as to take at least a part of the second portion (44) towards the first portion (43).

4. The method of claim 1 wherein the step of pressing said second portion (44) is carried out shortly after a boundary between the first portion (43) and the second portion (44), wherein the boundary is a region of the package defined by the last lid of the stack inside the package.

5. The method of claim 1 wherein in the step of displacing the handle (23) so as to take at least a part of the second portion (44) towards the first portion (43), the handle (23) is displaced, in the beginning, following the radial direction of the set (42), and then following the axial direction of the set (42).

6. The method of claim 1 wherein the set (42) is displaced by transport device (1) simultaneously to the step of displacing handle (23) so as to take at least a part of the second portion (44) towards the first portion (43).

7. A transport device (1) for transporting the set (42) formed of stacked lids and inserted into a package comprising:

a support tool (3) to said set (42), adapted to hold the lids and the package;

a handling tool (4) movable relative to the support tool;

an immobilizing device (9) adapted for immobilizing a fold of the package, wherein the immobilizing device (9) includes movable jaws (12) provided with nails (13), the nails (13) extending in a horizontal plane beneath the stack lids inserted in the package;

the support tool (3) and the handling tool (4) being mounted on a movable platform allowing the displacement of said set (42).

8. The transport device (1) according to claim 7, wherein the handling tool (4) includes two handling rolls (32, 33) movable against each other.

9. The transport device (1) according to claim 8, wherein the handling rolls (32, 33) are free in axial rotation and are provided with rubber rings (36).

10. The transport device (1) according to claim 7 wherein the movable platform (2) includes a coupling plate (5) to a robotic arm (37).

11. The transport device (1) according to claim 7 wherein the support tool (3) is coupled to the movable platform (2) through a cylinder (20) allowing a translation of the support tool (3) in relation to the handling tool (4).

12. The transport device (1) according to claim 7 wherein the support tool (3) includes a stop (47) to the rear of said set (42).

13. A system for producing palletized sets of lids including a device (38) for forming sets of lids adapted to produce sets (42) formed of lids, stacked and inserted into a package, and a palletizing device (39) of said sets (42), comprising a transport device (1) as defined in claim 9, coupled to a robotic arm so that the transport device (1) is adapted to grasp sets (42) in said device (38) for forming sets of lids and to transport these sets (42) to the palletizing device (39) performing a packaging closure operation.

* * * * *